US007104055B2

(12) United States Patent
Matsubara et al.

(10) Patent No.: US 7,104,055 B2
(45) Date of Patent: Sep. 12, 2006

(54) PRESSURE VIBRATION GENERATOR

(75) Inventors: Yoichi Matsubara, Tokyo (JP); Shinichi Tohyama, Tsukuba (JP); Hiroyuki Sugita, Tsukuba (JP)

(73) Assignees: Japan Aerospace Exploration Agency, Tokyo (JP); Nihon University School Juridical Person, Tokyo (JP)

( * ) Notice: Subject to any disclaimer, the term of this patent is extended or adjusted under 35 U.S.C. 154(b) by 0 days.

(21) Appl. No.: 10/518,694

(22) PCT Filed: Mar. 4, 2003

(86) PCT No.: PCT/JP03/02486

§ 371 (c)(1),
(2), (4) Date: Dec. 17, 2004

(87) PCT Pub. No.: WO04/001303

PCT Pub. Date: Dec. 31, 2003

(65) Prior Publication Data

US 2005/0223705 A1 Oct. 13, 2005

(30) Foreign Application Priority Data

Jun. 19, 2002 (JP) ..... 2002-179141

(51) Int. Cl.

| | |
|---|---|
| ***F01K 27/00*** | (2006.01) |
| ***F25B 9/00*** | (2006.01) |
| ***F25B 9/14*** | (2006.01) |
| ***F02G 1/04*** | (2006.01) |
| ***F02G 1/043*** | (2006.01) |
| ***F01B 29/10*** | (2006.01) |
| ***F01B 11/08*** | (2006.01) |

(52) U.S. Cl. ..... 60/520; 60/516; 62/6

(58) Field of Classification Search ..... 60/516, 60/520; 62/6

See application file for complete search history.

(56) References Cited

U.S. PATENT DOCUMENTS 4,114,380 A * 9/1978 Ceperley ..... 60/721
4,717,405 A 1/1988 Budliger (Continued)

FOREIGN PATENT DOCUMENTS

JP 06-147686 5/1994

(Continued)

OTHER PUBLICATIONS

"Experimental research of thermoacoustic prime mover"; Shuliang Zhou and Yoichi Matsubara; Cryogenics vol. 38, No. 8 (1998) pp. 813-822.

(Continued)

*Primary Examiner*—Sheldon J Richter
(74) *Attorney, Agent, or Firm*—Rankin, Hill, Porter & Clark LLP

(57) ABSTRACT

In the pressure oscillation generator 1, self-excited vibration is generated in a work transfer tube 30 by heating a heat input section 22 and also a resonator 50 is resonated, and when a work is inputted into a heat exchanger 20, the work is amplified by the heat exchanger 20, and is transferred to the heat transfer tube 30 and is then outputted to an output section 40. Because of the configuration, an outputted work can be amplified to a work larger than the inputted work, so that, by using a portion of the outputted work as energy for driving the cylinder 10, the pressure oscillation generator 1 can continuously be driven only by heating and without using electric energy generated by a large scale solar system or the like, which enables substantial size reduction of the pressure oscillation generator 1.

6 Claims, 1 Drawing Sheet

U.S. PATENT DOCUMENTS

| | | | | |
|---|---|---|---|---|
| 5,275,002 | A * | 1/1994 | Inoue et al. | 62/6 |
| 5,335,505 | A * | 8/1994 | Ohtani et al. | 62/6 |
| 5,412,952 | A * | 5/1995 | Ohtani et al. | 62/6 |
| 5,615,556 | A * | 4/1997 | Honda et al. | 62/6 |
| 5,904,046 | A * | 5/1999 | Kawano | 62/6 |
| 6,021,643 | A * | 2/2000 | Swift et al. | 62/6 |
| 6,032,464 | A * | 3/2000 | Swift et al. | 62/6 |
| 6,233,946 | B1 * | 5/2001 | Masuda | 62/6 |
| 6,389,819 | B1 * | 5/2002 | Zhu et al. | 62/6 |
| 6,434,947 | B1 * | 8/2002 | Zhu et al. | 62/6 |
| 6,725,670 | B1 * | 4/2004 | Smith et al. | 62/6 |
| 6,938,426 | B1 * | 9/2005 | Acharya et al. | 62/6 |

FOREIGN PATENT DOCUMENTS

| | | |
|---|---|---|
| JP | 08-014679 | 1/1996 |
| JP | 2000-088378 | 3/2000 |
| JP | 2001-141319 | 5/2001 |
| WO | WO 2004088217 A1 * | 10/2004 |

OTHER PUBLICATIONS

Thermally Driven 4K Pulse Tube Cryocooler; Y. Matsubara and S.I. Zhou, Proceeding of the Sixth Joint Sino-Japanese Seminar on Cryocooler and its Applications, Lanzhou, China (2000) pp. 38-43.

"A pressure Wave Generator for Pulse Tube Cooler"; Y. Matsubara, W. Dai, H. Sugita and S. Tooyama.

* cited by examiner

PRESSURE VIBRATION GENERATOR

TECHNICAL FIELD

The present invention relates to a pressure oscillation generator (pressure vibration generator), and more specifically, to a pressure oscillation generator used for supplying pressure oscillation to, for instance, a pulse tube refrigerator.

BACKGROUND ART

Recently researches are very active in examining the possibility of mounting a refrigerating machine such as a pulse tube (cryo) refrigerator or the like in a satellite for cooling various types of components and devices in the satellite. The pulse tube refrigerator functions by supplying pressure oscillation to a pulse tube, and as the pressure oscillation generator for generating vibration pressure, there have been proposed those using electric energy, or more specifically those each comprising a compressor driven by an electric motor and an electronically controlled switch valve provided therein. In this case, a large size solar system for converting thermal energy from the Sun to electric energy is required to be mounted on the satellite to obtain sufficient electric energy for driving the pressure oscillation generator.

In the conventional types of solar systems, however, as the conversion efficiency from thermal energy to electric energy is extremely low, it is required to use solar panels or the like with very large size for obtaining sufficient electric energy, which causes various troubles when mounted on a satellite. Therefore, there has been strong need for size reduction of a pressure oscillation generator.

DISCLOSURE OF THE INVENTION

A main object of the present invention is to provide a pressure oscillation generator enabling further size reduction.

The pressure oscillation generator according to the present invention comprises a work generating section for work input, a heat exchanger having a heat removal section on a work input side thereof, to which the work from the work generating section is inputted, and also having a heat input section on a work output side thereof, a work transfer tube provided on the heat input side of the heat exchanger, an output section provided on the work output section of the work transfer tube, and a resonator branching from a section between the work transfer tube and the output section.

In the pressure oscillation generator according to the present invention as described above, when the heat input section is sufficiently heated, self-excited vibration is generated in the work transfer tube, and the resonator provided on the work output side of the work transfer tube resonates. In this state, when a work (pressure wave) is inputted from the work generating section to the heat removal section of the heat exchanger, the work is amplified via the heat exchanger, transferred to the work transfer tube, and outputted to the output section. Namely, the pressure oscillation generator also functions as an amplifier. As the work outputted in the amplified state is larger than the inputted work, by using a portion of the outputted work as energy for driving the work generating section, the pressure oscillation generator can continuously be driven only by heating, and without using electric energy or the like. Therefore when the pressure oscillation generator is used for supplying pressure oscillation to a pulse tube refrigerator or the like mounted in a satellite, it is required to provide the heat input section so that the heat input section is directly heated by the solar heat or the like, and it is not required to use a large scale solar system for converting the thermal energy as described above to electric energy, so that the size reduction of the pressure oscillation generator can further be promoted.

In the pressure oscillation generator according to the present invention, the work output side of the work transfer tube and the work generating section are preferably communicated to each other via a returning section for returning a portion of the work outputted from the work transfer tube to the work generating section.

With the configuration as described above, as the work output side of the work transfer tube and the work generating section are communicated to each other via the return section, so long as the heat input section is heated, also the work generating section is continuously driven in the self-excited state by a portion of the work outputted from the work transfer tube, and even a switch mechanism for starting driving and the like are not required in the pressure oscillation generator, so that the configuration is further simplified and further size reduction of the pressure oscillation generator is possible.

In the pressure oscillation generator according to the present invention, the resonator preferably comprises a hollow accommodation body communicated to the section between the work transfer tube and the output section, a solid displacer provided in the accommodation body, and a bias section for biasing the solid displacer so that the displacer can vibrate in the accommodation body.

A resonance tube having the simple configuration is known as a general resonator. Although the resonance tube has the simple configuration, the length is required to be long for achieving the sufficient effect, so that a large dedicated space for accommodating is disadvantageously required.

In contrast, as the solid displacer is vibrated within the accommodation body, the length can be minimized so long as a required amplitude of the solid displacer can be insured so that the size reduction is secured.

In the pressure oscillation generator according to the present invention, preferably at least one pair of the resonators are provided and are placed at positions opposing each other so that the solid displacers get closer to and apart from each other in the vibration direction thereof.

With the configuration as described above, as the solid displacers provided in the resonators repeat vibration in the direction in which vibrations of the two resonators cancel each other, so that such a trouble as mechanical vibration of the entire pressure oscillation generator never occurs.

BEST MODE FOR CARRYING OUT THE INVENTION

Figure 1:
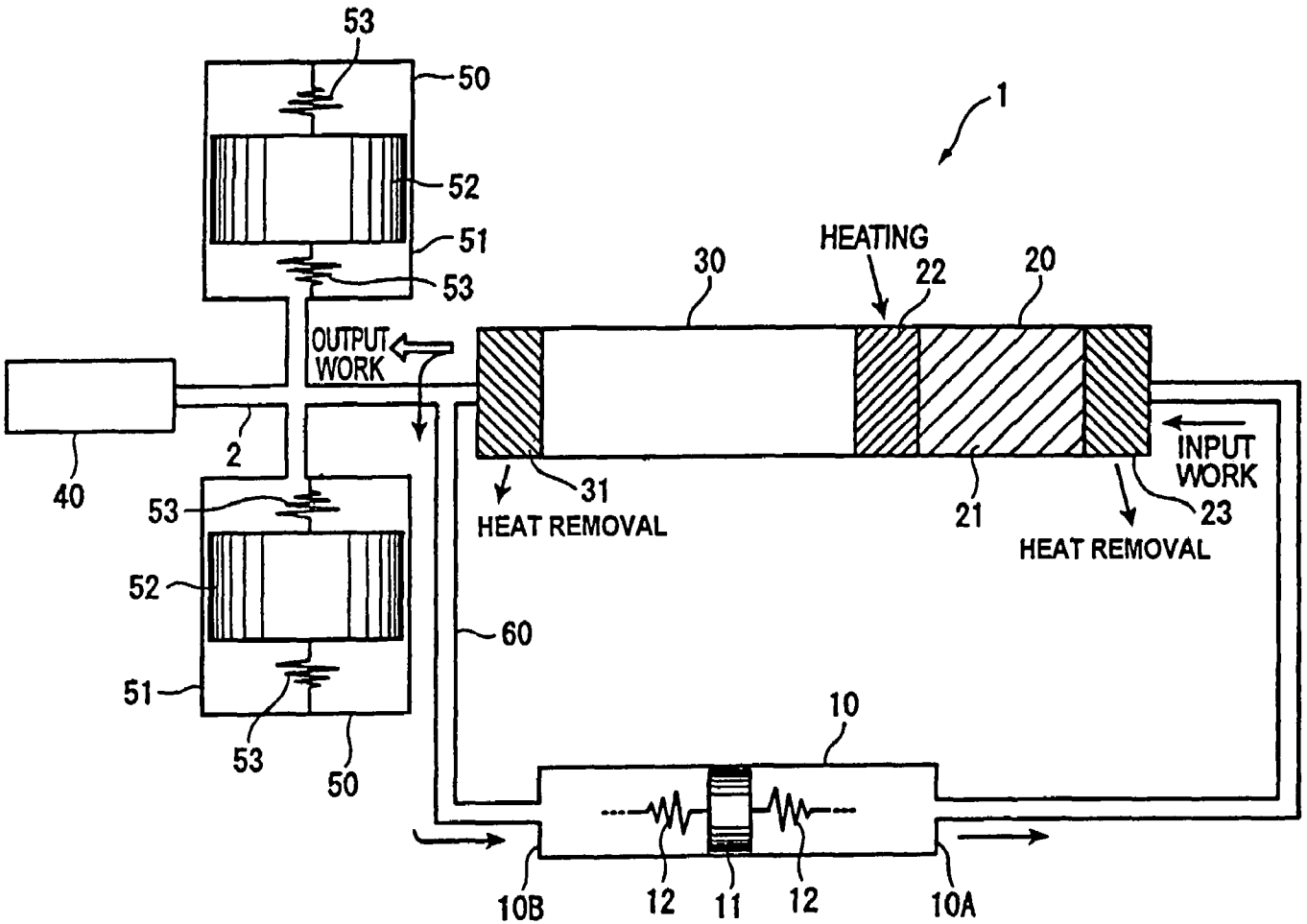
FIG. 1 is a simulated view showing a pressure oscillation generator according to an embodiment of the present invention as a whole.

An embodiment of the present invention is described below with reference to the related drawing.

FIG. 1 is a schematic view showing a pressure oscillation generator 1 according to the embodiment of the present invention.

The pressure oscillation generator 1 is a device for generating pressure oscillation in a working medium such as helium in a system, and is advantageously used for supplying the pressure oscillation to a pulse tube refrigerator mounted, for instance, on a satellite.

More specifically, the pressure oscillation generator 1 comprises a cylinder (work generating section) 10 for generating a pressure wave with a prespecified magnitude as an input work from a generating section 10A, a heat exchanger 20 receiving a work from the cylinder 10 at one edge thereof and outputting the work from the other edge thereof, a work transfer tube 30 connected to the output side of the heat exchanger 20, an output section 40 provided in the output side of the work transfer tube 30 with, for instance, a pulse tube refrigerator or the like connected thereto, a pair of resonators 50 branching from a conduit 2 between the work transfer tube 30 and the output section 40, and a conduit (returning section) 60 for communicating a returning section 10B of the cylinder 10 to the section between the work transfer tube 30 and the resonator 50, and the cylinder 10, heat exchanger 20, work transfer tube 30, and output section 40 are connected in series and communicated to each other.

The cylinder 10 comprises a piston 11 therein, the piston 11 being biased by a bias section 12 such as a spring so that the piston 11 can vibrate. When this piston 11 is vibrated with a prespecified frequency, a work (pressure wave) is generated from the generating section 10A, and can be inputted into the heat exchanger 20.

The heat exchanger 20 comprises a heat accumulator 21 provided at a center thereof, and a heat input section 22 is provided in one edge side of the heat accumulator 21, while a heat removal section 23 is provided in the other edge side. A work from the cylinder 10 is inputted into the heat removal section 23, and when the heat input section 22 is heated, the inputted work is amplified via the heat accumulator 21, and flows from the heat removal section 23 at a lower temperature to the heat input section 22 at a higher temperature, and is transferred to the work transfer tube 30. The phenomenon occurs because a flow of heat from the heat input section 22 to the heat removal section 23 is converted to a reverse work flow. The amplified work is outputted from the work transfer tube 30 to the output section 40.

On the other hand, when the heat input section 22 is fully heated, self-excited vibration occurs in the work transfer tube 30, and a resonator 50 resonates with a specified phase difference against the self-excited vibration. The heat removal section 31 is provided also in the output side of the work transfer tube 30, and releases heat generated in the output side.

Each resonator 50 comprises an accommodation body 51 communicated to an intermediate section of the conduit 2 and having a cylindrical form, a solid displacer 52 having a column-like form and accommodated in the accommodating body 51, and a bias section 53 such as a spring for biasing the solid displacer so that the solid displacer 52 can vibrate, and has the configuration in which the solid displacer 52 can vibrate in the axial direction but almost not vibrate in the radial direction. A weight of the solid displacer 52 and a biasing force provided by the bias section and decided by a spring constant or the like are previously set taking into considerations a phase difference against the self-excited vibration.

The resonators 50 are provided at positions opposing to each other with the conduit 2 therebetween, and vibrate in the direction in which the respective solid displacers 52 get closer to each together when the solid displacers 52 vibrate, and the vibrations cancel each other so that mechanical vibration of the entire pressure oscillation generator 1 is suppressed.

When a portion of the work outputted from the work transfer tube 30 is returned to a returning section 10B of the cylinder 10 via the conduit 60, this solid displace 52 vibrates the piston 11 in the cylinder 10 with the substantially same resonance frequency. The returned work is converted to a pressure wave for the input work described above in the cylinder 10.

In the embodiment as described above, when the heat input section 22 is gradually heated, self-excited vibration occurs in the work transfer tube 30, and when this self-excited vibration increases the magnitude, the resonator 50 resonates. The pressure wave generated in association with resonation of the resonator 50 is a standing wave, which can not be taken out as a work. A resonance frequency which is substantially the same as that of the pressure wave, namely which has a phase difference is given to the piston 11 inside the cylinder 10, and an input work (pressure wave) having the resonance frequency is self-excited in the generating section 10A and is inputted into the heat exchanger 20.

The input work is amplified by the heat accumulator 21 in the heat exchanger 20 and is transferred to the work transfer tube 30, and is then outputted as a traveling wave to the output section 40. Namely, the pressure oscillation generator 1 functions as an amplifier for amplifying an inputted work and outputted the amplified work. Further a portion of the outputted work is returned again to the cylinder 10 and is converted to an input work, and with this configuration, the pressure oscillation generator 1 is continuously driven without any electric energy source as that required in the conventional type of solar panel.

To explain the pressure oscillation generator 1 by referring to a specific example, when a work of "1 unit" is inputted in the stably heated state, if the work can be amplified to "3 units", "1 unit" of the "3 units" is returned to the cylinder 10 and can be converted again to an input work, and the remaining "2 units" can be used for driving the pulse tube refrigerator and the like. Then the returned "1 unit" is again amplified to "3 units", and thus "2 units" can successively be taken out with "1 unit" returned.

With the embodiment of the present invention as described above, there are provided the following advantages:

(1) The pressure oscillation generator 1 itself can function as an amplifier, and an outputted work can be amplified to a work larger than the inputted work, so that, by converting a portion of the outputted work as energy for driving the cylinder 10, the pressure oscillation generator 1 can continuously be driven without being heated and also without using electric energy or the like. Because of the feature as described above, when the pressure oscillation generator 1 is used for supplying pressure oscillation to a pulse tube refrigerator or the like mounted in a satellite, it is required that the heat input section 22 is directly heated by the solar heat or the like, and a large scale solar system for converting the thermal energy to electric energy is not required to be used, so that substantial size reduction of the pressure oscillation generator 1 is possible.

(2) In the pressure oscillation generator 1, a work output side of the work transfer tube 30 and the cylinder 10 are communicated to each other with the conduit 60, so that, so long as the heat input section 22 is being heated, the cylinder 10 can continuously be driven in the self-excited state by using a portion of the work outputted from the work transfer tube 30, so that the pressure oscillation generator 1 does not require a switch mechanism and the like for starting a driving operation, which allows further simplification and further size reduction thereof.

(3) The resonator 50 in the pressure oscillation generator 1 vibrates the solid displacer 52 in the accommodation body 51 and require a smaller length as compared to the case in which a lengthy resonance tube is used so long as an amplitude of the solid displacer 52 is secured, which insures the size reduction thereof.

(4) The resonators 50 are provided at opposite positions with the conduit 2 therebetween, and the respective solid displacers 52 repeat vibration in the direction in which the respective vibrations cancel each other, and such a trouble as mechanical vibration of the entire pressure oscillation generator 1 can be prevented, which improves durability and reliability of the pressure oscillation generator 1.

The present invention is not limited to the embodiment described above, and other configurations capable of achieving the object of the present invention are allowable, and the variants as described below are also included in a scope of the present invention.

For instance, description of the pressure oscillation generator 1 in the embodiment above assumes the configuration in which a pulse tube refrigerator is connected to the output section 40, but the component connected to the output section 40 is not limited to the pulse tube refrigerator, and any device driven by pressure oscillation such as a piston may be connected to the output section 40.

In the embodiment above, a portion of an outputted work is returned via the conduit 60 to the cylinder 10, but the configuration is allowable in which the conduit 60 is not provided and the piston 11 in the cylinder 10 is driven with electric energy. In this configuration, a solar system or the like is required for obtaining electric energy, but a power required for driving the piston 11 is smaller as compared to that for driving a compressor or a switch valve as used in the conventional technology, so that only a small size solar system is required, and even when the small size solar system as described above is used, substantial size reduction of the pressure oscillation generator is possible, so that objects of the present invention can be achieved.

The specific configurations of the work generating section, resonator, and returning unit according to the present invention are not limited to those described in the embodiment above, and any configuration may be employed when carrying out the present invention.

INDUSTRIAL AVAILABILITY

The present invention can be used as a pressure oscillation generator for supplying pressure oscillation to a pulse tube refrigerator and the like, and can be used as a cooling device for various types of components and devices mounted in a satellite.

The invention claimed is:

1. A pressure oscillation generator comprising: a work generating section for generating an input work; a heat exchanger having a heat removal section on a work input side thereof, to which the work from the work generating section is inputted, and also having a heat input section on a work output side thereof; a work transfer tube provided on the heat input side of the heat exchanger; an output section provided on the work output side of the work transfer tube; and a resonator branching from a section between the work transfer tube and the output section.

2. The pressure oscillation generator according to claim 1, wherein said resonator comprises a hollow accommodation body connected to a section between said work transfer tube and sand output section, a solid displacer provided inside the accommodation body, and a bias section for biasing the solid displacer so that the solid displacer can vibrate in said accommodation body.

3. The pressure oscillation generator according to claim 2, wherein at least one pair of said resonators are provided at positions opposing each other so that the solid displacers get closer to or apart from each other in the vibration direction thereof.

4. The pressure oscillation generator according to claim 1, wherein the output side of said work transfer tube and said work generating section are communicated to each other via a returning section for returning a portion of a work outputted from said work transfer tube to said work generating section.

5. The pressure oscillation generator according to claim 4, wherein said resonator comprises a hollow accommodation body connected to a section between said work transfer tube and sand output section, a solid displacer provided inside the accommodation body, and a bias section for biasing the solid displacer so that the solid displacer can vibrate in said accommodation body.

6. The pressure oscillation generator according to claim 5, wherein at least one pair of said resonators are provided at positions opposing each other so that the solid displacers get closer to or apart from each other in the vibration direction thereof.

* * * * *